United States Patent [19]

Makansi

[11] Patent Number: 4,529,368

[45] Date of Patent: Jul. 16, 1985

[54] APPARATUS FOR QUENCHING MELT-SPUN FILAMENTS

[75] Inventor: Munzer Makansi, Signal Mountain, Tenn.

[73] Assignee: E. I. Du Pont de Nemours & Company, Wilmington, Del.

[21] Appl. No.: 566,061

[22] Filed: Dec. 27, 1983

[51] Int. Cl.[3] ..... B29C 25/00

[52] U.S. Cl. ..... 425/72 S; 264/176 F; 264/237

[58] Field of Search ..... 425/72 S; 264/176 F, 264/237

[56] References Cited

U.S. PATENT DOCUMENTS

| | | | |
|---|---|---|---|
| 2,273,105 | 2/1942 | Heckert | 264/176 F |
| 3,067,458 | 12/1962 | Dauchert | 264/176 F |
| 3,280,424 | 10/1966 | Heijnis | 264/176 F |
| 3,320,343 | 5/1967 | Buschmann et al. | 264/176 |
| 3,487,144 | 12/1969 | Sarian | 264/237 |
| 3,834,847 | 9/1974 | Fletcher | 425/72 |
| 4,225,299 | 9/1980 | Roberts | 425/72 S |

FOREIGN PATENT DOCUMENTS

| | | | |
|---|---|---|---|
| 4528726 | 6/1967 | Japan | 425/72 S |

*Primary Examiner*—Jay H. Woo
*Assistant Examiner*—J. L. Fortenberry

[57] ABSTRACT

An apparatus for melt-spinning and cross-flow quenching of synthetic organic polymer filaments is improved by incorporation of a tubular delayed quench assembly extending from the spinneret and projecting into the cross-flow quench chimney. The projecting portion of the assembly is foraminous. An improvement in filament decitex uniformity is achieved especially with fine filaments.

7 Claims, 4 Drawing Figures

APPARATUS FOR QUENCHING MELT-SPUN FILAMENTS

BACKGROUND OF THE INVENTION

1. Field of the Invention

This invention relates to the production of meltspun filaments of synthetic organic polymer. In particular, the invention concerns an improved cross-flow quenching apparatus that improves the decitex uniformity of the filaments.

2. Description of the Prior Art

Apparatus for cross-flow quenching of melt-spun filaments of synthetic organic polymer have long been known in the art, as for example, from U.S. Pat. No. 2,273,105, Heckert. In conventional apparatus of this type, melt-extruded filaments are supplied from spinneret orifices to an elongated chamber, called a "cross-flow chimney." Air is supplied to the chimney from a plenum through a plenum outlet that is substantially coextensive with one wall of the chimney. The plenum outlet usually contains means for reducing the turbulence in the air supplied to the chimney. Among the known air turbulence reducing means are open cell foams, perforated plates, screens, and the like which fit across the entire cross-section of the plenum outlet. Within the chimney the air flows from the plenum outlet through and around the filament array in substantially straight line paths that are substantially perpendicular to the paths of the filaments.

Although the known cross-flow quenching methods have been used extensively in the commercial production of melt-spun synthetic organic polymer filaments, yarns made from these filaments still have shortcomings in dtex uniformity along their length, especially when the filaments are of low dtex (e.g., less than 8, and especially when less than 5). Such nonuniformities lead to difficulties in subsequent operations such as dyeing and draw texturing. Thus, the purpose of this invention is to provide an improved apparatus that will increase the decitex uniformity of the melt-spun filaments.

SUMMARY OF THE INVENTION

The present invention provides an improved apparatus for producing filaments of synthetic organic polymer. The apparatus is of the type wherein molten polymer is extruded through spinneret orifices to form filaments and the thusly-formed filaments are supplied to an elongated cross-flow chimney wherein the filaments are quenched by a flow of air supplied from a plenum chamber through a plenum outlet that is substantially coextensive with one wall of the cross-flow chimney. The plenum outlet contains air turbulence reducing means and directs the air flow substantially perpendicular to the paths of the filaments. The improvement of the present invention for increasing filament decitex uniformity comprises a tubular delayed quench assembly, located immediately downstream of the spinneret, having a central passage through which the filaments are advanced from the spinneret into the cross-flow chimney, and including a foraminous outlet portion which protrudes into the cross-flow chimney.

It is preferred that the delayed-quench assembly include an imperforate inlet tube which is sealed to the face of the spinneret holder and is connected to the foraminous outlet portion. In preferred embodiments of the apparatus the outlet portion of the delayed quench assembly is a cylindrical screen or a screen of oval cross-section. Usually the protruding foraminous outlet portion is separated from the plenum outlet by a minimum distance in the range of 4 to 15 centimeters, preferably in the range of 5 to 10 centimeters. In another preferred embodiment, the length of the imperforate inlet tube is in the range of 3 to 13 centimeters and the foraminous outlet portion projects into the cross-flow chimney for a distance of at least 5 centimeters.

BRIEF DESCRIPTION OF THE DRAWINGS

The invention will be more readily understood by reference to the drawings wherein.

DETAILED DESCRIPTION OF PREFERRED EMBODIMENTS

Figure 1:
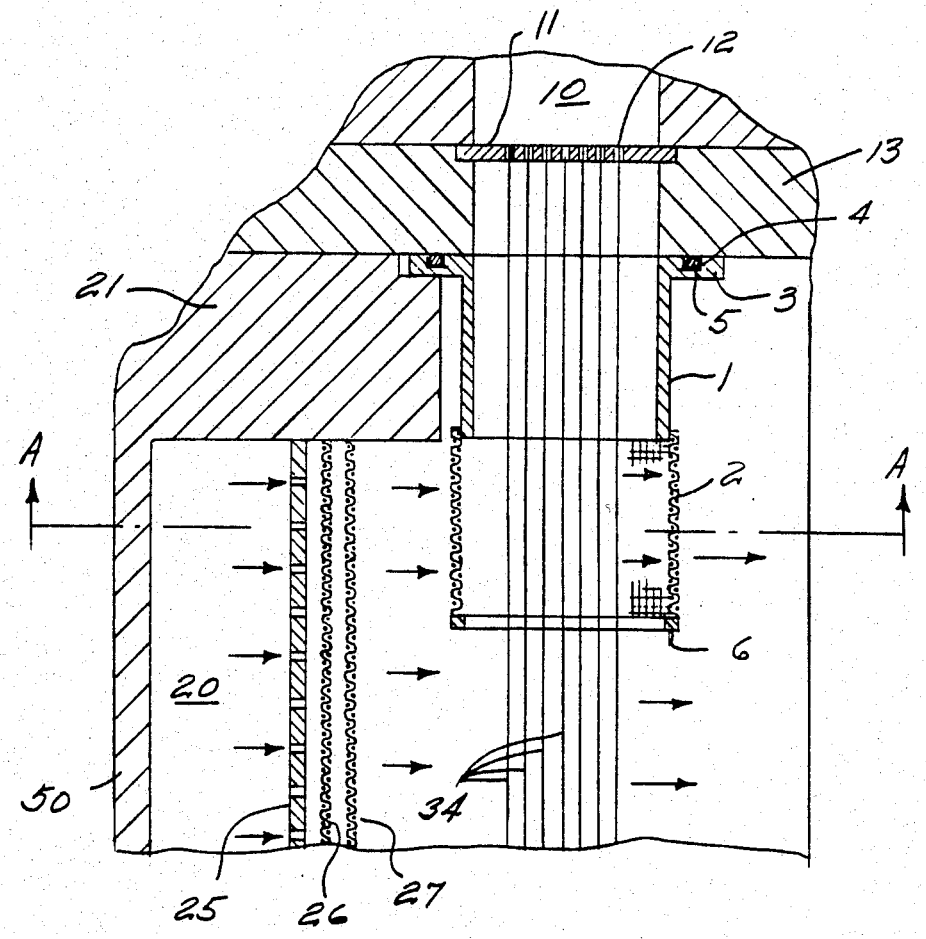
FIG. 1 is a vertical cross-section view through the lower end of a melt extrusion unit and the upper end of a cross-flow chimney in which a delayed quench assembly is incorporated in accordance with the present invention.

The preferred embodiments selected for illustrating the present invention and its operation are depicted in the drawings and are described in further detail in the example.

Figure 2:
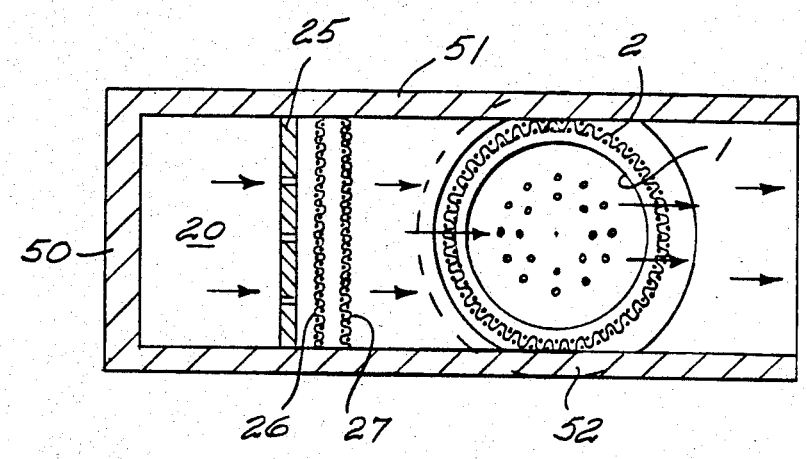
FIG. 2 is a horizontal cross-sectional view through A—A of FIG. 1.

As indicated above, the filament-producing apparatus of the present invention combines conventional means for extruding synthetic organic polymer and cross-flow cooling of the filaments with a novel tubular delayed quench assembly. The conventional means for extruding the polymer, as shown in FIG. 1, includes passage 10 which supplied molten polymer to spinneret 11, located in spinneret holder 13. The molten polymer is extruded through spinneret orifices 12 to form filaments 34. The filaments are advanced by puller rolls (not shown) from the orifices into and through conventional cross-flow cooling means. In FIGS. 1 and 2 the top, back wall and side walls of the cross-flow cooling means are respectively designated by numerals 21, 50, 51 and 52. The conventional cross-flow cooling means includes a plenum 20 which supplies air through a series of turbulence reducing elements into a cross-flow chimney. As shown in FIGS. 1 and 2, the turbulence reducing elements include perforated plate 25 and two screens 26 and 27 which are located in and coextensive with the outlet of the plenum. The cross-flow chimney is the elongated chamber defined by screen 27 and side walls 51 and 52. The air, as shown by the arrows in FIGS. 1 and 2, flows from the plenum outlet into and through the cross-flow chimney in substantially straight-line paths that are substantially perpendicular to the paths of the filaments.

Figure 3:
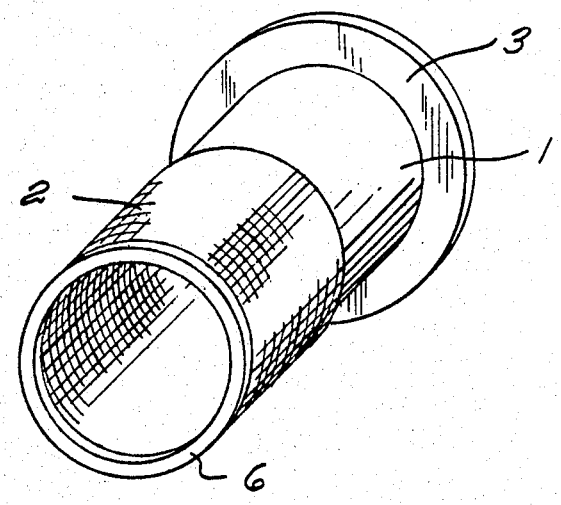
FIG. 3 is an oblique view of a delayed quench assembly.

Filaments 34, in advancing from spinneret orifices to the cross-flow chimney, pass through a tubular delayed quench assembly of the type shown in FIG. 3. The delayed quench assembly, which constitutes the key novel feature of the apparatus of the present invention, has a central internal channel of sufficient size to permit ready passage of the filaments and comprises an imperforate inlet member 1 and a foraminous outlet member 2. In the figures, imperforate inlet member 1 is illustrated as a tube and foraminous outlet member 2 as a tubular screen. Imperforate inlet tube 1 is located immediately downstream of spinneret 11. At its upstream end tube 1 has flange 3 through which the delayed quench assembly is supported on the walls of the cross-flow cooling means. Groove 4 of flange 3 contains sealing element 5, which forms a seal between the face of spinneret support 13 and the central passage of the delayed quench assembly. As a result of this sealing, a zone of relatively quiescent air is created inside tube 1 in the region between spinneret 11 and the outlet of tube 1. The outlet end of tube 1 is connected to one end of screen 2. The other end of screen 2 protrudes into the cross-flow chimney. Stiffening ring 6 is attached to the protruding end of screen 2 to add stiffness and sturdiness to the screen. The direction of the air flow inside the portion of screen 2 that protrudes into the cross-flow chimney is substantially the same as that outside the screen. However, the air velocity inside screen 2 is somewhat lower than the air velocity outside the screen. It is believed that tubular screen 2 creates a zone of unusually low turbulence in the air that passes in cross-flow through screen 2 to cool filaments 34. A 30-mesh screen is preferred for the foraminous member 2 of the delayed quench assembly, but screens of larger or smaller mesh can also be used.

Use of the delayed quench assembly in accordance with the invention results in significant improvements in the dtex uniformity of yarns prepared from filaments made with the delayed quench assembly as compared to yarns prepared from filaments manufactured without such a delayed quench assembly. As shown in the examples below, dtex nonuniformity could be reduced by as much as 50% by use of the present invention in the production of fine dtex yarns.

The cross-section of the delayed quench assembly can be any convenient shape, such as circular or oval. With regard to the foraminous outlet member 2 which projects into the cross-flow chimney, it is preferred that the projecting portion be a tubular screen which surrounds the entire array of filaments. Such a screen would protect the filament array from undesired air currents coming from outside the exit of the chimney. Nonetheless, a "half screen" located between the walls 51 and 52 of the chimney and forming a semicircular element between the outlet of plenum 30 and the filaments 34 can provide a significant portion of the dtex improvement that is obtained with a tubular screen for projecting outlet member 2.

For greater effectiveness in improving dtex uniformity the foraminous member 2 of the cross-flow quench assembly is considerably closer to the filament array than to the plenum outlet. Practical considerations usually dictate that member 2 be no closer than 0.5 cm away from any of the filaments and usually no more than 2.5 cm away. In contrast, the minimum distance between the protruding portion of member 2 and the final turbulence reducing element 27 in the outlet of plenum 20 is generally in the range of 4 to 15 cm, but more usually in the range of 5 to 10 cm.

The length of imperforate inlet member 1 of the delayed quench assembly usually is in the range of 3 to 13 cm. Usually, foraminous outlet member 2 protrudes into the cross-flow chimney at least 5 cm. The maximum length of the protruding portion is dictated by the cross-section dimensions of member 2 and how much bowing of the filaments is caused by the transverse flow of the cooling air. The protruding length must not be so long as to cause the bowing filaments to come in contact with the walls of the delayed quench assembly.

Figure 4:
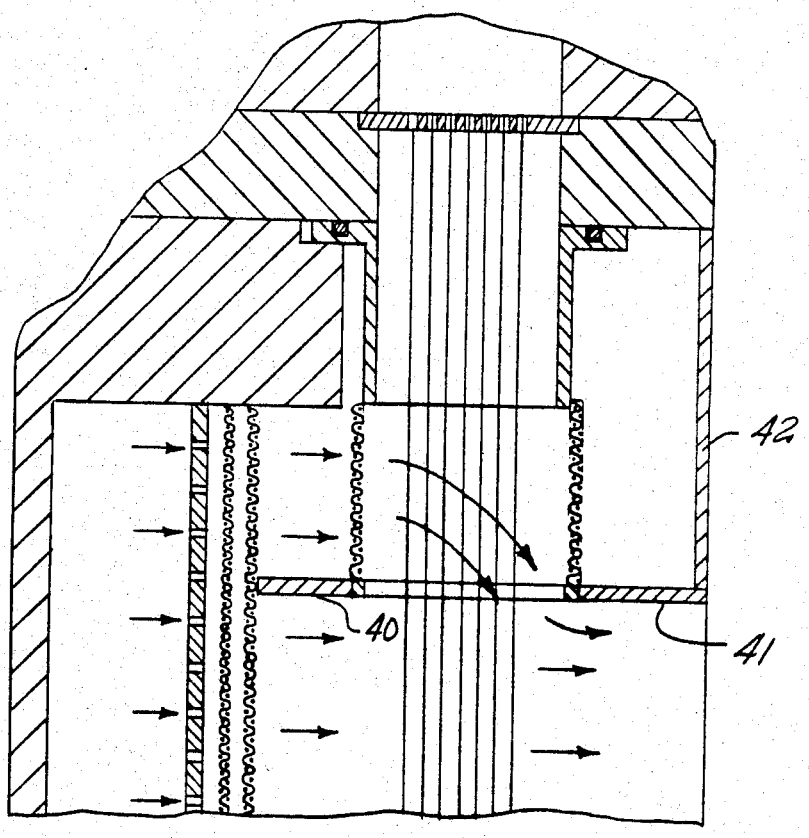
FIG. 4 is a view, similar to that of FIG. 1, of another apparatus of the invention.

FIG. 4 illustrates additional ways in which the delayed quench assembly can be arranged with conventional melt-spinning and cross-flow cooling equipment in accordance with the invention. FIG. 4 differs from FIG. 1 in that FIG. 4 includes three optional plates 40, 41 and 42 which may be used individually or in combination. Plate 40 provides additional support for the delayed quench assembly and prevents entry of stray currents into the air stream flowing toward the protruding portion of the delayed quench assembly. Plate 41 also provides additional support for the delayed quench assembly and can prevent undesirable currents of air from entering the assembly. Plate 42 prevents air currents from outside the chimney from entering the delayed quench assembly. When all three plates are used in combination, some of the air flow travels in a bent-line path, as shown by the arrows in FIG. 4, in its passage through the chimney. For the purposes of this invention, however, flow with this deviation from straight-line paths is considered to be substantially equivalent to the straight-line cross-flow of the preferred embodiments.

In the Example which follows, yarn uniformity is reported as a percent decitex spread along the length of the yarn. An apparatus of the type disclosed in U.S. Pat. No. 3,273,380 was employed for measuring the natural frequency of vibration of a continuously advancing yarn and for converting the measurement into a continuous indication of mass per unit length (dtex). Spread in dtex was calculated by dividing the difference between the maximum and minimum dtex measured in a 27.4 meter long sample by the average dtex of that sample. Any value of dtex spread reported in the example is expressed as a percentage and is the average value obtained from determinations on eight 27.4 meter long samples. The relative viscosity reported for the polyester polymer employed in the Example was measured at 25° C. for a 4.75% by weight solution of the polymer in hexafluoroisopropanol containing 100 ppm of sulfuric acid.

EXAMPLE

This example demonstrates the advantageous improvement in yarn uniformity that is provided by the present invention. For this example five polyester yarns were prepared with the improved cross-flow quenching apparatus of the present invention and compared to corresponding yarns prepared with conventional prior art cross-flow cooling apparatus.

Polyethylene terephthalate of 20.7 relative viscosity was melt-spun by the general procedure disclosed in U.S. Pat. No. 3,771,307 to form 34 filament yarns. All of the filaments were of low dtex. Yarns 1–4 and their comparison yarns were of circular cross-section. The filaments of yarn 5 and its comparison yarn were of octalobal cross-section of the type disclosed in U.S. Pat. No. 4,041,689. Equipment substantially as depicted in FIGS. 1 and 2 (with a plate 40 as shown in FIG. 4) was employed to extrude and cool the yarns. Immediately upon exiting the cross-flow cooling chimney, finish was applied to the yarn and then the yarn was interlaced in accordance with the general procedures of U.S. Pat. No. 3,110,151 and finally wound up with no drawing. The yarns were intended for use as draw-twist texturing feed yarns.

The spinnerets used for each of the yarns contained 34 orifices arranged in two concentric circles of 5.4 cm and 3.8 inch diameters. The orifices were equally spaced around the circumference of each circle. For Yarns 1, 2 and 5 and their respective comparison yarns the outer circle contained 20 orifices and the inner circle 14 orifices. For yarns 3 and 4 and their respective comparison yarns each circle contained 17 orifices.

The outlet of the plenum through which air was supplied to the cross-flow cooling chimney employed for making each of the yarns of this example contained a series of turbulence reducing elements which consisted essentially of a perforated plate of about 8.6% free area, a first screen of 50 mesh made of 0.009 inch (0.229 mm) diameter wire and a second screen of 100 mesh made of 0.0045 inch (0.114 mm) diameter wire. The two screens were 0.375 inch (9.5 mm) apart and the first screen and the perforated plate were 0.5 inch (12.7 mm) apart. The plenum outlet was rectangular and measured about 21 inches long by about 3 inches wide (53×7.5 cm). The side walls of the cross-flow cooling chimney were about 3 inches (7.5 cm) apart. The final screen of the plenum outlet was 5.25 inches (13.3 cm) from the center of the extruded filament array.

In making the yarns with apparatus in accordance with the present invention, a delayed-quench assembly of generally oval shape was employed. The inlet member of the delayed-quench assembly was an imperforate tube of about 1.5 inch (3.8 cm) length. The entrance to the tube was sealed to the face of the spinneret holder. The cross-section of the tube had a major axis of about 4.4 inches (11.3 cm) and a minor axis of about 2.9 inches (7.3 cm). The outlet foraminous member of the delayed-quench assembly was a metal screen of the same oval shape as the inlet member. The oval screen was slipped over and connected to the inlet tube. The screen, which was 30 mesh and made of 0.0135 inch (0.34 cm) diameter wire, protruded 2.5 inches (6.4 cm) into the cross-flow chimney.

Comparison yarns were prepared in the same manner and in the same equipment for each of the yarns made in accordance with the invention, except that the delayed quench assembly of the invention was replaced by a 4 inch (10 cm) long rectangular duct measuring about 2.9 inches (7.3 cm) by 4.4 inches (11.3 cm) in cross-section.

Additional details concerning the preparation of the yarns of this example are given in Table I, along with values of the percent decitex spread for the yarns produced. Note that Yarns 1–5 which were made with apparatus in accordance with the present invention had dtex spreads which were respectively only 57, 52, 52, 82 and 76% of the dtex spreads for the corresponding comparison yarns. Note also that the improvement was greater for yarns made with filaments of lower dtex.

As a result of the improved uniformity of yarns made with the apparatus of the invention, the yarns were more easily processed at significantly higher rates on draw twist texturing equipment than was possible with the comparison yarns.

TABLE I

| Test No. | 1 | 2 | 3 | 4 | 5 |
|---|---|---|---|---|---|
| Extrusion temp., °C. | 283 | 284 | 288 | 289 | 290 |
| Windup speed, m/min | 3,520 | 3,004 | 3,100 | 3,118 | 3,141 |
| Cross-flow air velocity | | | | | |
| Inside screen, m/min | 24.4 | 24.4 | 24.4 | 28.0 | 28.0 |
| Below screen, m/min | 29.9 | 29.9 | 29.9 | 39.6 | 39.6 |
| Yarn total dtex | 118 | 139 | 189 | 283 | 278 |
| dtex per filament | 3.4 | 4.1 | 5.6 | 8.3 | 8.2 |
| % dtex Spread | | | | | |
| a. Example yarn | 2.9 | 2.2 | 1.6 | 1.8 | 1.9 |
| b. Comparison yarn | 5.1 | 4.2 | 3.1 | 2.2 | 2.5 |
| Ratio (a/b) | 0.57 | 0.52 | 0.52 | 0.82 | 0.76 |

It will be apparent that many widely different embodiments of this invention may be made without departing from the spirit and scope thereof, and therefore it is not intended to be limited except as indicated in the appended claims.

I claim:

1. An improved apparatus for producing synthetic organic polymer filaments, wherein molten polymer is extruded through spinneret orifices to form filaments which are forwarded to an elongated crossflow chimney wherein the filaments are quenched by a flow of air which is supplied through turbulence reducers from a plenum outlet that is substantially coextensive with one wall of the chimney and is directed substantially perpendicular to the paths of the filaments, the improvement for increasing the decitex uniformity of the melt extruded filaments comprising a tubular delayed quench assembly located immediately downstream of the spinneret, having a central passage through which the filaments are advanced from the spinneret into the cross-flow chimney and including a foraminous outlet portion which protrudes into the cross-flow chimney.

2. An apparatus of claim 1 wherein the delayed quench assembly includes an imperforate inlet tube which is sealed to the face of a spinneret holder and is connected to the foraminous outlet portion.

3. An apparatus of claim 1 or 2 wherein the outlet portion of the delayed quench assembly is a cylindrical screen.

4. An apparatus of claim 1 or 2 wherein the outlet portion of the delayed quench assembly is a screen of oval cross-section.

5. An apparatus of claim 1 or 2 wherein the protruding foraminous outlet portion of the delayed quench assembly is separated from the plenum outlet by a minimum distance in the range of 4 to 15 centimeters.

6. An apparatus of claim 5 wherein the minimum distance is in the range of 5 to 10 centimeters.

7. An apparatus of claim 2 wherein the imperforate inlet tube has a length in the range of 3 to 13 centimeters and the foraminous outlet portion projects into the cross-flow chimney for a distance of at least 5 centimeters.

* * * * *